United States Patent [19]

Prager

[11] 4,073,371

[45] Feb. 14, 1978

[54] APPARATUS AND CIRCUITS FOR TWO-COLOR PRINTING IN ELECTRONIC IMPACT PRINTERS

[75] Inventor: Jay Prager, Hudson, N.H.

[73] Assignee: Centronics Data Computer Corporation, Hudson, N.H.

[21] Appl. No.: 631,936

[22] Filed: Nov. 14, 1975

[51] Int. Cl.[2] ..... B41J 33/56

[52] U.S. Cl. ..... 197/157; 197/1 R; 197/82

[58] Field of Search ..... 197/1 R, 151, 157, 158, 197/159, 82; 101/336

[56] References Cited

U.S. PATENT DOCUMENTS

| | | | |
|---|---|---|---|
| 1,517,843 | 12/1924 | Lake | 197/157 |
| 2,947,357 | 8/1960 | Bafour et al. | 197/157 X |
| 3,037,606 | 6/1962 | Blain et al. | 197/157 X |
| 3,082,854 | 3/1963 | Becker et al. | 197/157 UX |
| 3,139,964 | 7/1964 | Fischer | 197/157 |
| 3,170,035 | 2/1965 | Moebius | 197/157 X |
| 3,200,740 | 8/1965 | Schaller et al. | 101/336 X |
| 3,703,949 | 11/1972 | Howard et al. | 197/1 R |
| 3,741,364 | 6/1973 | Becker | 197/151 |
| 3,861,305 | 1/1975 | Sasaki | 101/336 |
| 3,939,957 | 2/1976 | Bittner | 197/151 |

*Primary Examiner*—Ernest T. Wright, Jr.
*Attorney, Agent, or Firm*—Louis Weinstein

[57] ABSTRACT

Color control means for selectively positioning one color of a two-color ribbon between a document-supporting platen and a print head having means for selectively impacting the desired ribbon portion against the document, said color control means comprising a color-select solenoid energized by logic circuitry responsive to a print-color signal. The solenoid is energized to a first position to enable characters of a first color to be printed at selected positions along a line. The logic circuitry includes means for selectively deleting the line feed, and delaying the print enable and print head movement signals during a time interval sufficient to allow for the color select solenoid to move the ribbon to the opposite color position at which time the characters of the opposite color are printed. A modification of the logic circuitry enables a dot-matrix impact printer capable of printing in both the forward and reverse directions to print a single line of intermixed characters of first and second colors in a somewhat similar fashion.

14 Claims, 8 Drawing Figures

TO TAPE READER
FROM TAPE READER
CONTROL UNIT (INCLUDES CIRCUIT 50 OR 80)
CLEAR
SHIFT REGISTER
CHAR. GEN.
MOTOR 16
(FROM 14d)
INPUT LINE
10
11
12
12a
12b
13
14
14a
14b
14c
14d
14e
14f
14g
14h
14i
14k
15
15a
16
17
18
19
20
21
22
23
23a
23b
24
25
26
27
28
29

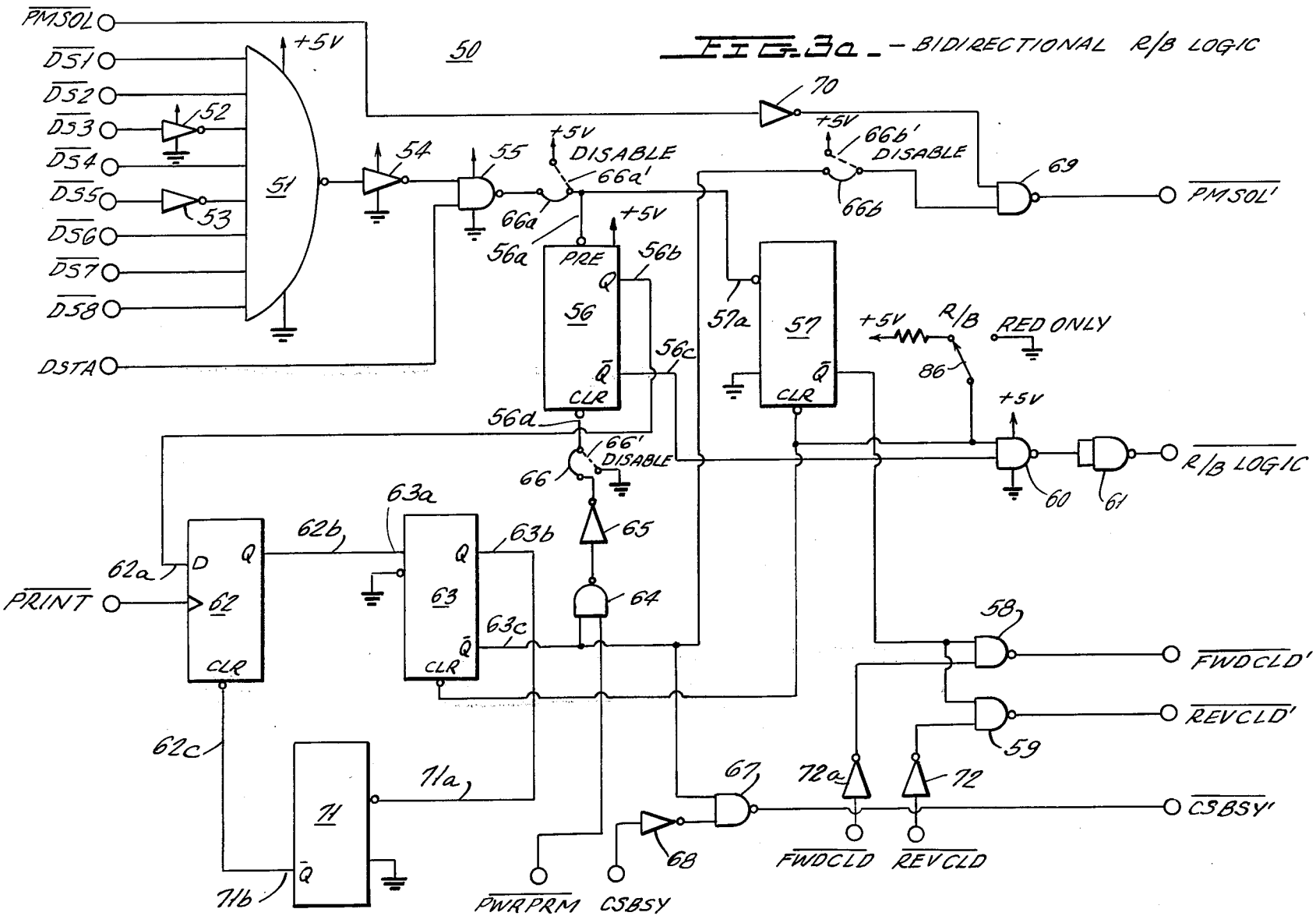
FIG. 3a - BIDIRECTIONAL R/B LOGIC
PMSOL'
R/B LOGIC
FWDCLD'
REVCLD'
CSBSY'
RED ONLY
R/B
DISABLE
REVCLD
FWDCLD
CSBSY
PWRPRM
PRINT
PMSOL
DS1
DS2
DS3
DS4
DS5
DS6
DS7
DS8
DSTA
+5V
50
51
52
53
54
55
56
56a
56b
56c
56d
57
57a
58
59
60
61
62
62a
62b
62c
63
63a
63b
63c
64
65
66
66a
66a'
66b
66b'
67
68
69
70
71
71a
71b
72
72a
86
PRE
CLR
Q
D

BIDIRECTIONAL PRINTER SIGNALS (NOTE: RELATIVE TIMES OF EVENTS NOT TO SCALE)

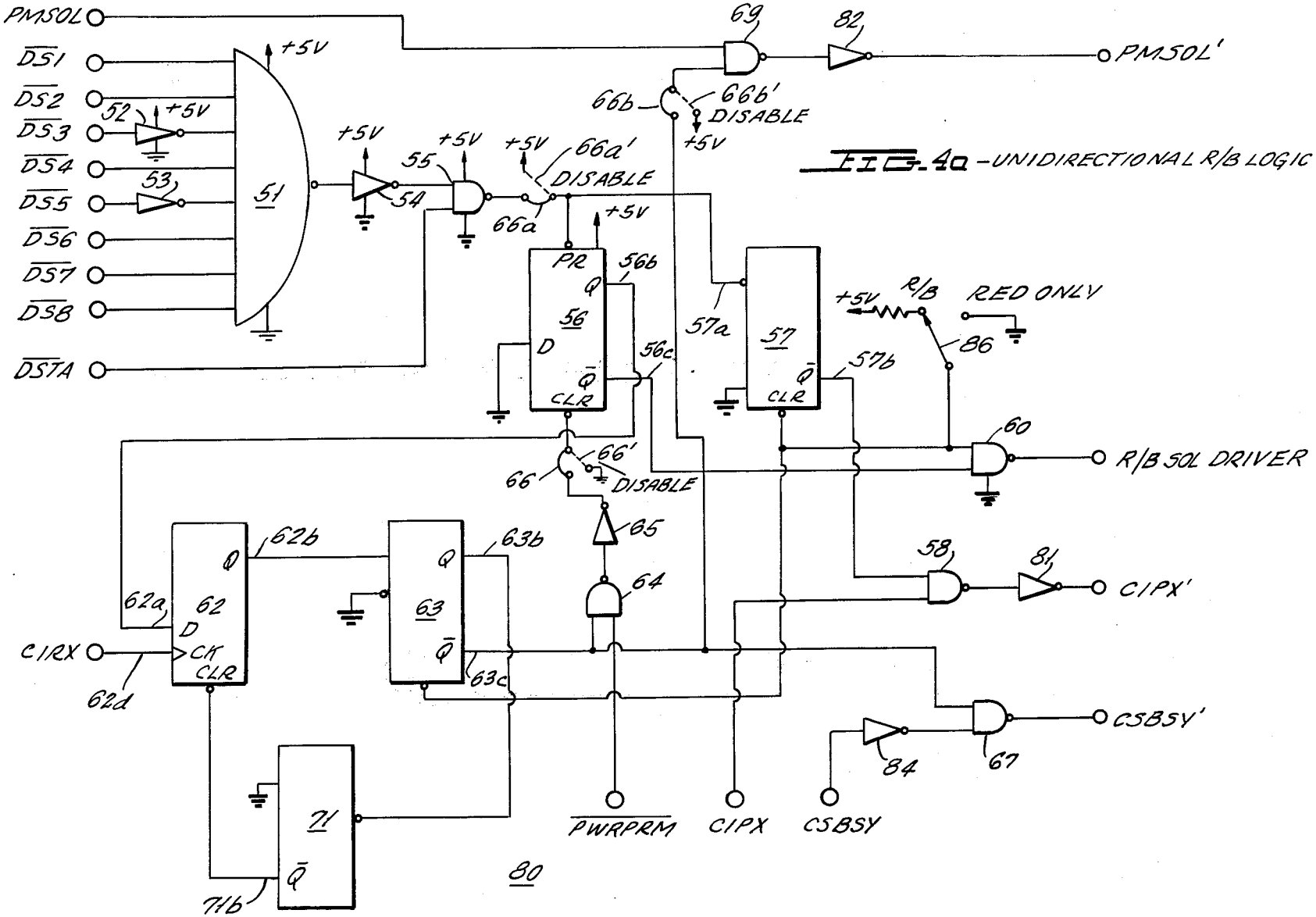
FIG. 4a - UNIDIRECTIONAL R/B LOGIC
PMSOL'
R/B SOL DRIVER
CIPX'
CSBSY'
RED ONLY
R/B
+5V
DISABLE
CSBSY
CIPX
PWRPRM
PMSOL
DS1
DS2
DS3
DS4
DS5
DS6
DS7
DS8
DSTA
CIRX
80

SIGNAL CONDITIONS IN UNIDIRECTIONAL PRINTER (NOTE: RELATIVE TIMES ARE NOT TO SCALE)

APPARATUS AND CIRCUITS FOR TWO-COLOR PRINTING IN ELECTRONIC IMPACT PRINTERS

BACKGROUND OF THE INVENTION

The present invention relates to electronic dot matrix impact printers and more particularly to novel apparatus and circuitry for achieving two-color printing therein.

Conventional electronic dot-matrix impact printers use a print head containing a plurality of solenoid-driven print wires to selectively urge each print wire end against an inked ribbon positioned above the surface of a paper document and the like, to print a row of dots thereon. The print head is mounted on a carriage movable across the document, while selected combinations of print wires are driven against the ribbon and paper to form a group of dot columns which collectively represent a line of dot-matrix characters. Typically, a dot-matrix impact printer prints in only one color, generally black. In certain applications it is desirable to be able to either print each line in one of two colors, such as black and red, or print lines of intermixed characters of first and second colors.

BRIEF DESCRIPTION OF THE INVENTION

In accordance with the invention, apparatus and circuitry for two-color printing in an electronic impact printer comprises means for selectively vertically positioning, responsive to a color shift signal, one of a pair of colored portions of an inked ribbon between a paper document and a print head having an array of print wires selectively activated to impact the ribbon and the paper; circuit means for recognizing a color-selection code; means for selectively moving the ribbon positioning means to a first color-position responsive to the recognition of the color-selection code; means for delaying the start of printing for a predetermined time interval sufficient to allow the ribbon to reach the selected position; means for energizing the ribbon positioning means to another color-position when the print head has completed a forward movement across the paper document; and means for preventing generation of a line feed signal to move the paper document until the remaining characters along the line are printing in the remaining color. When printing only in one color, generally black, the coded color-selection signal is not transmitted to the logic circuitry to retain the ribbon positioning means in the proper position. The logic circuitry includes selection means for allowing the color-selection logic to remain indefinitely in the normal position.

In a preferred embodiment, a manual control switch is provided for enabling the additional colored ribbon portion, generally red, to be permanently positioned between the print wire array and the paper document, whereby all printing is carried out in the second color, regardless of the reception of the coded color-selection signal.

Accordingly, it is one object of the present invention to provide apparatus for selectively enabling printing in either of two colors in an impact printer.

It is another object of the present invention to provide logic circuitry for enabling apparatus to position either colored portion of a two-color ribbon between a document and a print head to achieve two color printing in an impact printer.

It is yet another object of the present invention to provide means for delaying the initiation of line printing in an impact printer having the capability to selectively print in either one of two colors until the color positioning apparatus has been properly aligned.

It is a further object of the present invention to provide logic circuitry for an impact printer requiring a plurality of separate movements across the width of a paper document to print a line of intermixed first and second color characters which circuitry deletes a line feed operation to enable intermixed characters of first and second colors to be completed.

These and other objects of the present invention will become apparent when reading the accompanying detailed description and the drawing.

BRIEF DESCRIPTION OF THE FIGURES

FIG. 3*a* is a schematic diagram illustrating logic circuitry for enabling the solenoid and linkage apparatus and for interfacing the electronics portion of a bi-directional printing impact printer therewith;

FIG. 4*a* is a schematic diagram illustrating logic circuitry for enabling the solenoid and linkage apparatus for interfacing the electronics portion of a unidirectional impact printer therewith.

DETAILED DESCRIPTION OF THE INVENTION

Figure 1:
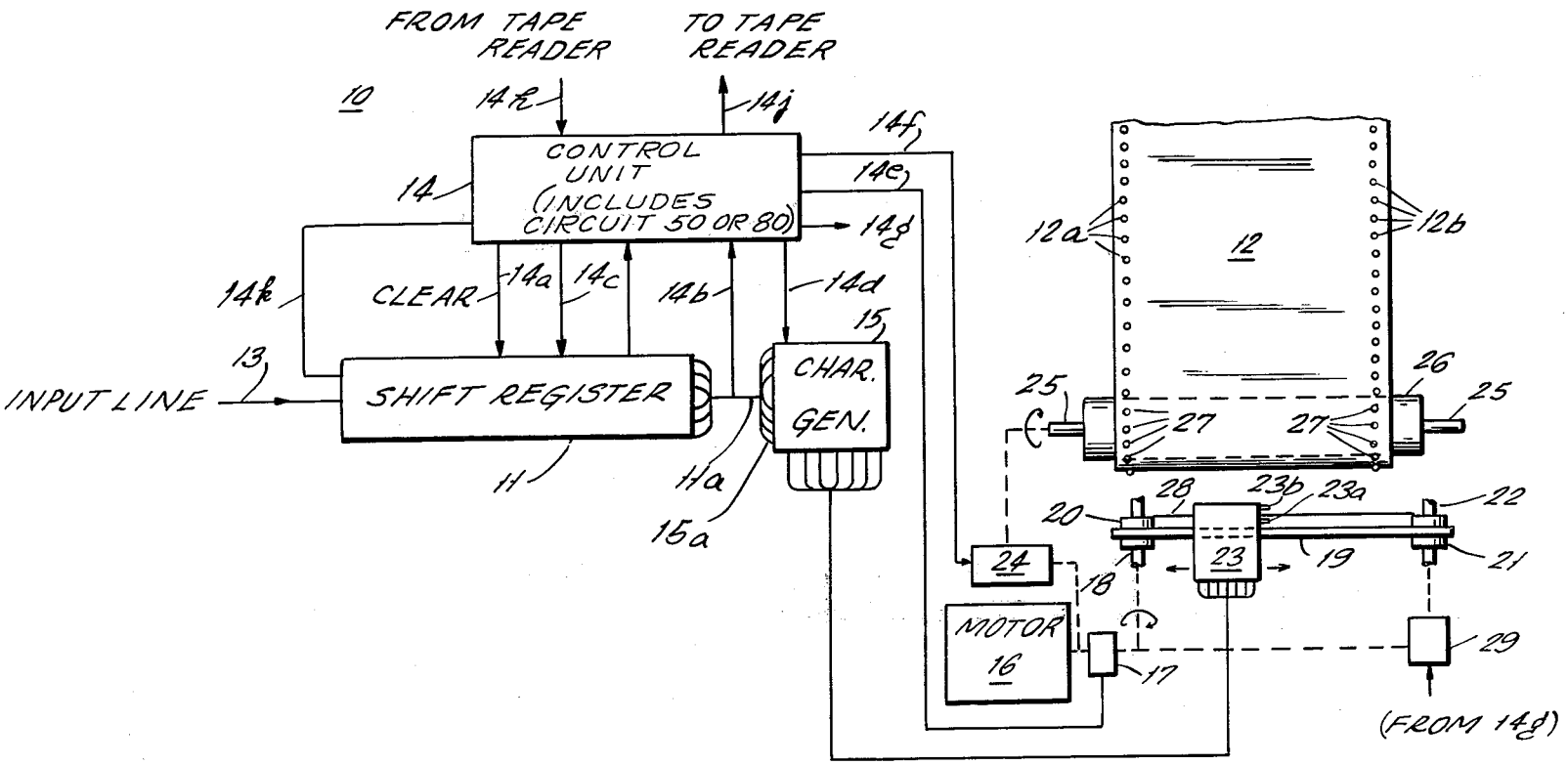
FIG. 1 shows a block diagram of a printer capable of printing dot matrix characters in either a unidirectional or bidirectional manner.

FIG. 1 shows a printer 10 which may, for example, be an inpact printer of the dot matrix type such as is described in detail in U.S. Pat. No. 3,703,949 issued Nov. 28, 1972 and assigned to the assignee of the present invention.

The printer 10 utilizes a multistage shift register 11 having a plurality of stages preferably greater in number than the number of characters which may be printed along one line of paper document 12. For example, in an 80-column printer (capable of printing 80 characters per line of print) the shift register 11 may be comprised of 81 stages, each stage being capable of storing an eight bit binary word.

Binary coded words are loaded into shift register 11 through input line 13 in a parallel by bit, serial by word fashion.

The control unit 14 "initializes" the printer 10 when the power is first turned on to clear shift register 11 through its output line 14*a* so as to clear out the contents of shift register 11. Thereafter, control unit 14 through its output 14*k* loads a "dummy" character into the input stage of shift register 11. Thereafter, binary coded words are applied to input line 13 either from a communications interface or a computer or the keyboard which may form a part of the printer but which has been omitted herein for purposes of simplicity. As each code word, which may either be a character word or a function word, is loaded into shift register 11, control unit 14 applies a shift pulse at output 14c to shift register 11 to advance the code words loaded into shift register 11 towards the output stage.

As soon as the "dummy" character reaches the output stage of shift register 11 it is detected through lead 14b of control unit 14 to apply an additional shift pulse through lead 14c to shift register 11 to shift the dummy character out of the register 11. Thus, the output stage will now contain the first character code to be printed and this output code is applied through lead 11a to respective inputs of a character generator 15 which has stored therein the dot matrix patterns for alphabetic characters, numeric characters and punctation signals, for example. The binary code for the first character to be printed and appearing at the output stage of shift register 11 is applied to one set of inputs 15a of character generator 15 which develops a dot column pattern for five successive dot columns.

Output 14e of control unit 14 activates a clutch assembly 17 coupled between the output shaft of continuously operating motor 16 and the input shaft 18 of a print head carriage drive belt 19 entrained about a pair of pulley gears 20 and 21 mounted on shafts 18 and 22, respectively. A print head assembly 23, which is slidably mounted upon guide rods 32, 34 (FIG. 1a) is mechanically coupled to belt 19 so as to be moved from the left to the right-hand margin of paper document 12 continuously during the printing of a line.

Figure 2:
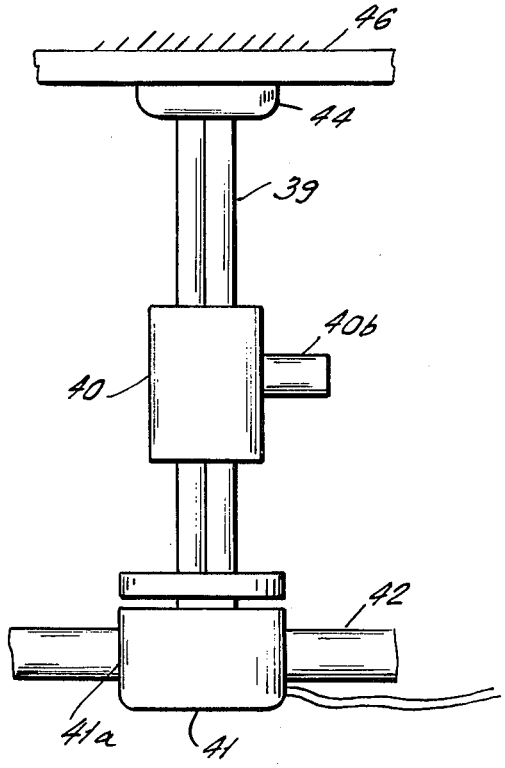
FIG. 2 is a top view of the solenoid and linkage apparatus and of a part of the impact printer in which it is used.

As was mentioned hereinabove, characters are of the dot matrix type whereby a seven row by five column dot pattern containing a total of 35 dot positions is utilized to form each character. FIG. 2 of above mentioned U.S. Pat. No. 3,703,949 shows the dot pattern formats for the numerals 0–6 and the alphabetic characters A-G.

Characters are formed in a dot column by dot column fashion as the print head assembly 23 moves across paper document 12. A stationary registration strip 28 is positioned parallel to platen 26. The strip 28 is preferrably provided with uniformly spaced transparent slits. A light source 23a and photocell 23b are mounted to move with print head assembly 23 to generate pulses employed to trigger the print head solenoids. A decoder (not shown) is coupled to the photocell 23b and converts the pulses into one of six possible outputs, the first five pulses being adapted to select the dot column to be printed and the sixth pulse advancing the next coded character in register 11 into the output stage in readiness for printing the next character (or symbol). After five dot columns are completed, control unit 14, through its shift pulse output 14c shifts the next character code into the right-hand most or output stage of shift register 11 to apply this character code to character generator 15. Characters are formed across the printed line in this fashion until either the end of the line is reached or until a function code is detected in the output stage of shift register 11 indicating that the line of print is completed (if less than a full line). Control unit 14 detects this code and causes clutch 17 to decouple motor 16 from shaft 18 enabling the print head assembly 23 to move from right to left, typically under the control of a spring return device (not shown for purposes of simplicity). A suitable limit switch may be provided to detect the fact that the print head assembly 23 has reached the end of a line of print (i.e. the right-hand margin), which condition is utilized to return the print head assembly 23 to the left-hand margin of the paper document 12 and to execute a single line feed operation. In the case where a line of print terminates before the print head assembly 23 reaches the right-hand margin of the paper document 12, a carriage return/line feed code is shifted into register 11 and is detected by control unit 14 to deenergize clutch 17 and thereby enable the print head assembly 23 to return to the left-hand margin under the control of the return spring in readiness for printing the next line.

In order to perform a line feed operation, output 14f of control unit 14 energizes clutch 24 to couple the output shaft of motor 16 to the shaft 25 of the paper document advancing mechanism which may, for example, be a cylindrical platen 26 mounted to rotate upon shaft 25 and provided with a plurality of pins or sprockets 27 which protrude through the equispaced openings 12a and 12b provided along opposite margins of the paper document 12. The clutch 24 is activated for a time period sufficient to advance paper document 12 by one line space for single line feeds. Multiple line feeds may be provided under control of a tape provided in a tape reader connected to the control unit 14 by leads 14h and 14j. If desired, in unidirectional printers, the return spring may be replaced by a reverse clutch 29 activated by output 14g of control unit 14 to return the print head assembly 23 to the left-hand margin. The reverse clutch 29 is also used in bidirectional printers.

Referring to FIGS. 1, 1a, 1b and 2, a portion of an electronic impact printer 10 includes a plurality of print wires 30 selectively extendable in the direction of arrow A from the forward end or nose 23c of print head assembly 23 to impact against an inked ribbon 31 aligned substantially parallel with and between a paper document 12 and the tips of print wires 30.

A pair of carriage guide rods 32 and 34 are slidable received within apertures 33a and 33c formed in carriage member 33. Carriage member 33 is movable along rods 32 and 34 in either direction by the motor 16 and clutch means 17 and 29 (see FIG. 1) coupled thereto. Print head assembly 23 is rigidly fastened to carriage member 33 and is moved across paper document 12 in either direction as shown in FIG. 1. At selected positions along the line traversed across the width of paper document 12, selected combinations of the print wires 30 are driven to impact the ribbon 31 and paper document 12 to form the desired symbols and characters thereupon in the form of dot-matrix patterns. Operation is substantially as shown in the above-mentioned U.S. Pat. No. 3,703,949.

Inked ribbon 31 is comprised of an upper portion 31a and a lower portion 31b, generally equal in height, each saturated with an ink of a different color, typically red and black, respectively.

Ribbon positioning member 35 includes a pair of spaced parallel slotted apertures 35a formed through flat intermediate portion 35b. Ribbon positioning member 35 is positioned against the forward surface 33b of the carriage member 33 by a pair of headed studs 36 having a shank portion 36a freely passing through each aperture 35a and fastened within carriage member 33. The upper end of positioning member 35 is bent at 35d forming a substantially horizontally aligned portion 35c. The free end of portion 35c is bent upwardly at 35e and 35f forming two pairs 37–38 and 37a–38a of upright guides or fingers for supporting ribbon 31 so that the surface of the ribbon 31 lies substantially in an imaginary vertical plane substantially parallel to the plane of paper document 12.

Inked ribbon 31 is positioned between the pairs of fingers 37–38 and 37a–38a to be held parallel to paper document 12 and the forward end 23c of print head assembly 23. As will become apparent, positioning member 35 may be shifted to allow color portion 31a to be aligned with print wires 30 when ribbon positioning member 35 is moved in the direction of arrow B to its lower-most position, and to position color portion 31b between print wires 30 and paper document 12 when ribbon positioning member 35 is moved in the direction of arrow C to its upper-most position.

An actuator shaft 39, preferably having a square cross-section is positioned substantially parallel to carriage guide rods 32 and 34 and extends through the square shaped aperture 40a of slider member 40. Projection 40b extends radially outward from the exterior surface of slider member 40 and through a slotted aperture 35h in the lower end of ribbon positioning member 35. Slider member 40 is substantially freely slidable along the length of actuator shaft 39 responsive to the movement of carriage member 33 along carriage guide rods 32 and 34, which force is transmitted through headed studs 36 and ribbon positioning member 35 to projection 40b of slider member 40.

Rotation of actuator shaft 39 is imparted to slider member 40 to move projection 40b in the same rotational direction. Thus, if upper inked ribbon portion 31a is initially positioned adjacent print wires 30, rotation of actuator shaft 39 in a counter-clockwise direction as shown by arrow D also causes projection 40b to rotate in the counter-clockwise direction to urge ribbon positioning member 35 upwardly in the direction of arrow C to position the lower inked ribbon portion 31b in alignment with the print wires 30 to enable printing characters of one color. Rotation of actuator shaft 39 in the clockwise direction, opposite the direction of arrow D, causes slider member 40 to rotate in the same direction, urging ribbon positioning member 35 downwardly in the direction of arrow B to position upper inked ribbon portion 31a in alignment with the print wires 30 to cause the printing of characters of the other color.

An electrically actuatable torsion type solenoid 41 (FIG. 2) is affixed in an aperture 41a formed in one wall 42 of the impact printer 10. Actuator shaft 39 extends between solenoid 41 and a bearing 44 attached to an interior surface of another printer wall 46. Solenoid 41 is spring biased to normally position projection 40b in a plane generally transverse to the plane of ribbon positioning member 35 to normally position upper ribbon inked portion 31a between print wires 30 and paper document 12. The solenoid 41, when energized, rotates through a fixed angular displacement. Upon actuation, rotation of solenoid 41 rotates shaft 39, slider member 40 and its projection 40b upwardly to slide ribbon guide positioning member 35 upwardly as shown by arrow C (FIG. 1a) to move lower ribbon inked portion 31b into the proper position.

The actuator shaft 39, solenoid 41 and bearing 44 do not increase the total mass to be moved by carriage member 33.

Ribbon solenoid 41 is normally deactivated to print a full line in one color. To print a full line in the other color, ribbon solenoid 41 is activated. In cases where a line containing intermixed characters of both colors is desired, it is important to provide such a capability while maintaining the highest practical printing speed. Shifting the ribbon 31 at each color change is impractical since such operation would result in a significant reduction in printing speed.

Printing of intermixed first and second colored characters on a single line is accomplished by separating the full line of printer input data into two portions of data prior to transmission from the data source. The first data portion consists of all of the first color characters in a data line, with each of the second colored characters replaced by a space, or "blank", code. Similarly, the second line portion of data consists of all of the characters in the data line to be printed in the other color, with all of the previously printed characters replaced by a "blank" code. A color-select control code, typically consisting of 8 octally-coded parallel bits, is transmitted to the printer 10 prior to transmission of the first data portion of the line.

A typical electronically controlled dot-matrix impact printer 10 employing the solenoid driven print head assembly 23 of FIG. 1, prints in one color only (generally black). In certain applications, it is desirable to be able to print in two colors such as black and red. The circuits which are described below allow such printers to perform the following functions:

a. Print lines of all black characters;
b. Print lines of all red characters; and
c. Print lines of intermixed red and black characters.

The circuits to be described are respectively applicable to printers which print in both directions and to printers which print in only one direction.

BASIC TECHNIQUE

Figure 1A:
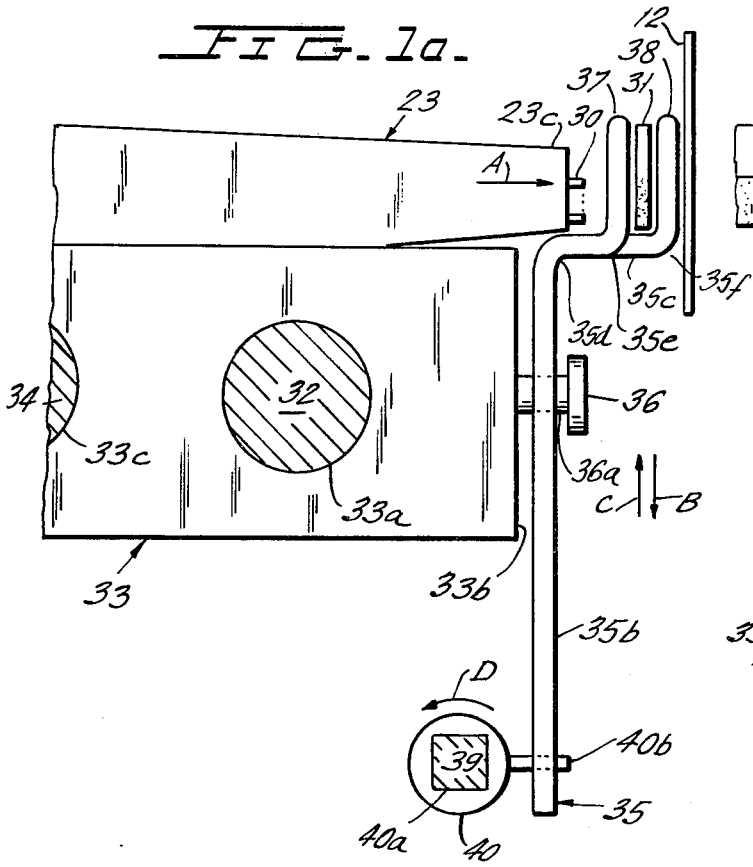
FIGS. 1*a* and 1*b* are respective side and front views of the print head and carriage mechanism of an impact printer and of a solenoid and linkage apparatus for selectively positioning each color portion of a two color ribbon with respect thereto, in accordance with the principles of the invention.
Figure 1B:
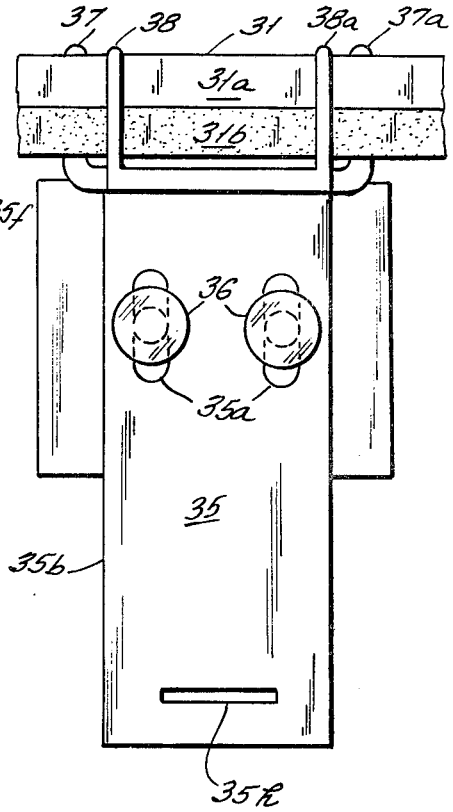

It is necessary to employ the two color inked printing ribbon 31 shown in FIGS. 1a and 1b to accomplish two color printing. The torsion-type solenoid 41 determines which color is to be printed. Thus, the normal position of the ribbon 31 will be with the black-inked portion 31a in front of the print head wires 30. To print in red, the ribbon 31 is indexed upwardly to place the red-inked portion 31b of the ribbon 31 in front of the print head assembly 23. Positioning is accomplished by way of the solenoid linkage arrangement described hereinabove.

To print full lines in black, the ribbon solenoid 41 remains deactivated. To print full lines in red, solenoid 41 is activated, moving the red portion 31b of the ribbon 31 in front of the print head assembly 23. Printing intermixed red and black characters on a single line utilizes the technique to be described in detail hereinbelow which technique avoids the requirement for making ribbon changes at each change in character color since this latter approach is quite impractical when printing at speeds of 165 characters per second, or greater.

To print intermixed red and black characters on a single line the technique employed is as follows:

The full line of data is separated, before transmission from the data source, into two separate data portions. The first data portion consists of all of the red characters in the line of data, with all of the black character positions being replaced with "space" or "blank" codes. The second data portion consists of all of the black characters in the line with all of the positions occupied by the red characters being replaced with "space" codes. Prior to transmission of the first data portion, a special red/black control code is transmitted. This code, by way of the circuitry to be described, activates the red/black solenoid (see solenoid 41 of FIG. 2) placing the red portion 31b of the ribbon 31 in front of the print head assembly 23. The first subline of data (red characters and spaces for the black characters) is transmitted to the printer 10 and printed. After printing the first portion of the line, the data representing the second portion of the line is transmitted to the printer 10. The circuitry to be described automatically disables the printer 10 from allowing the line feed signal PMSOL to occur so that the second line portion will be printed along the same line upon which the first line portion was printed. In addition, the circuitry to be described deactivates the red/black solenoid 41, placing the black portion 31*a* of the ribbon 31 in front of the print head assembly 23. Printing of the second line portion ensues, and, due to the manner in which the two line portions were arranged, and because of the inhibition of line feed, both line portions are intermixed in the same single line of print. Since each line portion was printed in a different color, an intermixed line of red and black characters results therefrom.

The circuitry for accomplishing red/black printing will now be described for bi-directional and then for unidirectional printing.

BI-DIRECTIONAL PRINTING

Figure 3B:
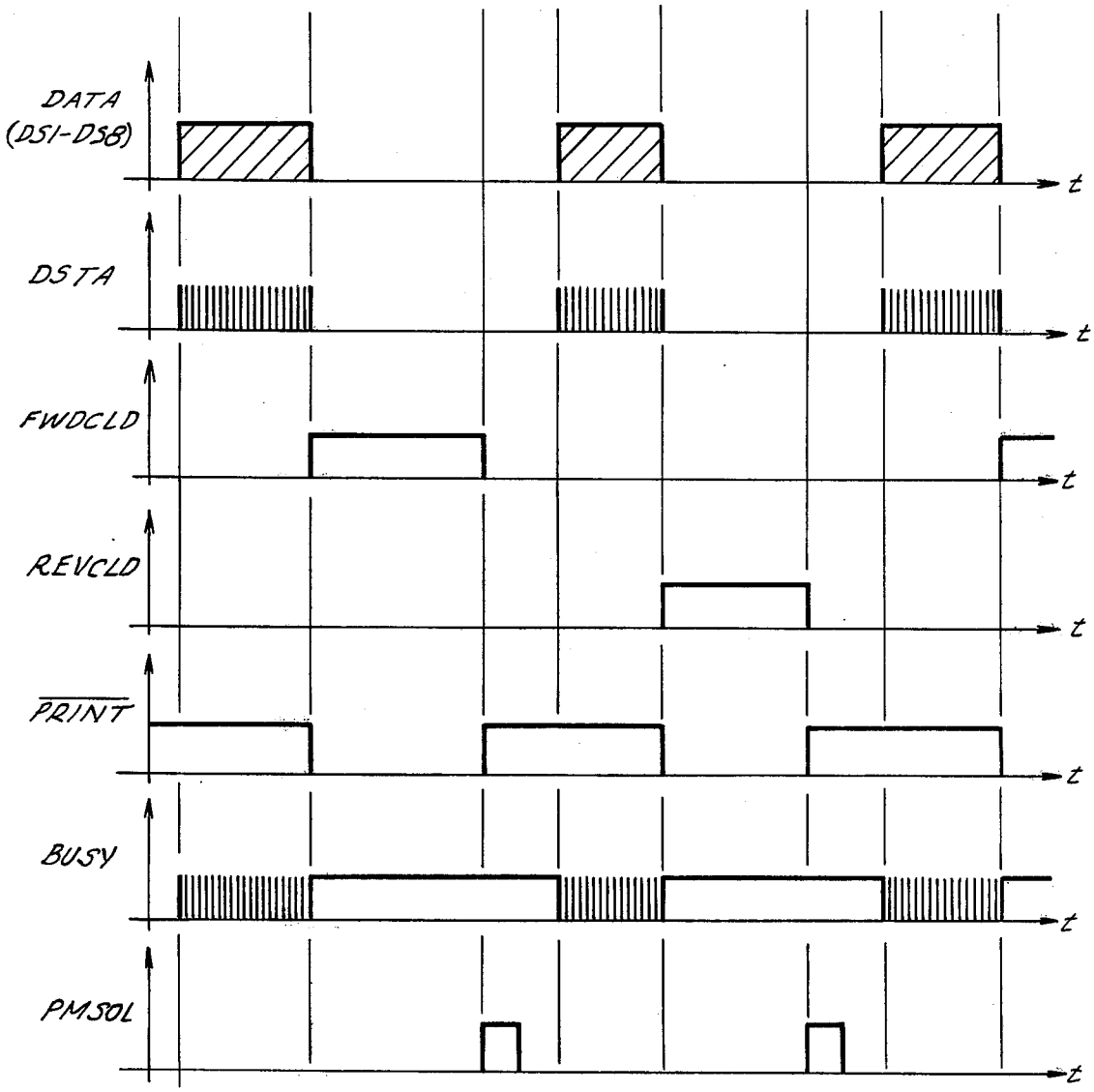
FIG. 3*b* is a coordinated set of graphs of logic signals used with the logic circuitry of FIG. 3*a;*

Referring to FIG. 3*a*, a schematic of the bi-directional red/black print logic is shown. FIG. 3*b* shows the signal conditions developed in a bi-directional printer 10 with the red/back logic of FIG. 3*a* being disconnected. Considering FIG. 3*b*, data from the computer or remote facility controlling the printer 10 is received on the $DS_1$ through $DS_8$ lines and is loaded in a coded character-by-coded character fashion in shift register 11. Printing ensues after the full (or partial) line of characters is loaded in shift register 11 which is indicated by movement of the dummy character into the output stage of shift register 11. In this instance the forward clutch drive signal FWDCLD goes high causing printing as the print head assembly 23 moves from the left to the right. The printer 10 goes "busy", developing a BUSY signal during printing to prevent the entry of new data during printing. After printing a line of data the signal $\overline{\text{FWDCLD}}$ goes low. It should be noted that the signal $\overline{\text{PRINT}}$ is high whenever both the forward clutch drive and reverse clutch drive signal levels (FWDCLD and REVCLD) are low. After printing, the paper movement solenoid signal PMSOL goes high causing a line feed and, a short time after the termination of the PMSOL signal, the printer 10 goes unbusy, i.e. the BUSY signal goes low, allowing new data to be loaded into shift register 11. DATA is taken in on the DSTA pulses and then a short busy interval follows each data input code as shown by the BUSY signal waveform diagram. After the next line of data is received the signal REVCLD goes high causing printing as the print head assembly 23 moves from right to left. This process continues as long as data is to be printed. The basic signals involved are:

(a) DS1 through DS8-parallel data inputs to the printer 10. Each combination of binary one and binary zero corresponds to a different character or control code.

(b) DSTA — the data strobe pulse which strobes the DS1 through DS8 data inputs into the printer storage buffers.

(C) FWDCLD — the forward clutch driver signal which engages the forward clutch (17 of FIG. 1) will allow printing from left to right.

(d) REVCLD — the reverse clutch drive signal which engages the reverse clutch (29 of FIG. 1) to allow printing from right to left.

(e) PRINT — the OR-ed combination of FWDCLD and REVCLD. This signal is high whenever either of the forward clutch drive of reverse clutch drive signals is high.

(f) BUSY — The printer 10 output to the data source (computer or the like) which indicates that the printer 10 is not ready to accept data. This signal is produced by the printer electronics but can be forced high by breaking into the internal CSBSY (cause busy signal) line in the printer 10.

(g) PMSOL — The paper movement solenoid signal. This signal, via a power driver circuit, directly causes the occurrence of a line feed by activation of the clutch 24 of FIG. 1. For reference, the length of the PMSOL pulse is typically less than 40 milliseconds.

Considering the circuitry 50 of FIG. 3*a*, the eight input NAND gate 51 is wired, in combination with the inverters 52 and 53, to respond to an octal 024 code (i.e. $\overline{DS1} = \overline{DS2} = \overline{DS4} - \overline{DS6} = \overline{DS7} = \overline{DS8} = 1$ and $\overline{DS3} - \overline{DS5} = 0$). The output is connected to one input of NAND gate 55 through inverter 54. This control code is recognized as a non-printable character by the remainder of the printer electronics and is not stored in register 11 (FIG. 1). This control code only affects the operation of the red/black logic. In fact, the octal 024 code is the red/black control code described hereinabove, and it is transmitted from the printer control facility (i.e. computer, for example) before the first line portion of data for an intermixed red and black data line (or for an all red line). The effect of the octal 024 control code is as follows:

(1) Upon the occurrence of the DSTA pulse accompanying the control code, the output of NAND gate 55 goes low causing flip-flop 56 to preset through application of a low signal to preset input 56*a*. This causes the output 56*b* to go high.

(2) One shot multivibrator 57 is triggered by the low-going signal at its input 57*a*. This causes a nominal 90 milliseconds low-going pulse to appear at the $\overline{Q}$ output inhibiting NAND gates 58 and 59. Inhibiting of NAND gates 58, 59 prevents $\overline{\text{FWDCLD}}$ or $\overline{\text{REVCLD}}$ coupled thereto by inverters 72*a* and 72, from engaging their respective clutches 17 and 29 for 90 milliseconds.

(3) The $\overline{Q}$ output 56*c* of bistable flip-flop 56 goes low causing the output of NAND gate 61 (which is connected to operate as an inverter) to go low, by way of NAND gate 60. This makes the $\overline{\text{R/B LOGIC}}$ signal appearing at the output of NAND gate 61 go low, causing the solenoid 41 to place the red portion 31*b* of the ribbon 31 in front of the print head assembly 23.

In summary, when an octal 024 control code is received, the following steps occur:

Solenoid 41 (FIG. 2), which positions the red portion 31*b* of the ribbon 31 in front of the print head assembly 23, is activated. At the same time, the clutch signals ($\overline{\text{FWDCLD}}$ and $\overline{\text{REVCLD}}$) are inhibited by NAND gates 58 and 59 to allow solenoid 41 to activate completely ($\overline{\text{FWDCLD}}'$ and $\overline{\text{REVCLD}}'$ are now employed to activate the clutches 17 and 29 in a manner to be more fully described). Thus printing cannot ensue until the ribbon 31 is properly placed in front of the print head assembly 23.

When transmission of data for the first line portion is complete, either $\overline{\text{FWDCLD}}$ or $\overline{\text{REVCLD}}$ will go low. Depending on the data rate, this may occur before or after the 90 milliseconds pulse generated by one-shot multivibrator 57 is complete. In any case, the corresponding $\overline{\text{REVCLD}}'$ or $\overline{\text{FWDCLD}}'$ cannot go low until after the pulse generated by one-shot multivibrator 57 has terminated.

Printing of the red characters then begins. During the latter series of events (data input) the PRINT signal is low (i.e. $\overline{\text{PRINT}}$ is high). When printing ensues the signal PRINT goes low. After printing of red characters is finished $\overline{\text{PRINT}}$ goes high again. Recalling that the octal 024 control code had set the Q output **56*b* of flip-flop 56 to its high state, this state is applied to the D input 62*a* of bistable flip-flop 62. When printing ceases and $\overline{\text{PRINT}}$ goes high, flip-flop 62 sets so that its Q output 62*b* goes high. This triggers one shot multivibrator 63 at its input 63*a*** which causes the following:

(1) The $\overline{Q}$ output **63*c* of one-shot multivibrator 63 goes low for 90 milliseconds. This signal is passed through NAND gate 64, inverter 65 and jumper connection 66 to clear input 56*d* of bistable flip-flop 56 setting the $\overline{Q}$ output 56*c* at the high level and, through gates 60 and 61, causing the signal $\overline{\text{R/B LOGIC}}$ to go high, turning off solenoid 41 to shift the black portion 31*a* of the ribbon 31 in front of the print head assembly 23. The $\overline{Q}$ output 63*c* of one-shot multivibrator 63 is also OR'ed into the CSBSY line which forces the printer 10 into the busy state for 90 milliseconds. This is accomplished by way of NAND gate 67 which receives the $\overline{Q}$ output of one-shot multivibrator 63 and the CSBSY signal through inverter 68. The output of NAND gate 67 generates the CSBSY' signal. This signal prevents data entry until the ribbon solenoid 41** has been completely reset.

(2) In addition, the $\overline{Q}$ output **63*c* of one-shot multivibrator 63 is coupled to one input of NAND gate 69 which inhibits the PMSOL signal at the output of inverter 70** from being generated out as $\overline{\text{PMSOL}}'$ so as to prevent the generation of a line feed signal.

(3) When one shot multivibrator 63 times out, its $\overline{Q}$ output **63*b* falls low triggering one-shot multivibrator 71 at its input 71*a*. Its $\overline{Q}$ output 71*b* is applied to the clear input 62*c* of bistable flip-flop 62 to clear flip-flop 62**.

Summarizing the operation, the effect of the $\overline{\text{PRINT}}$ signal going high is to reset the red/black ribbon solenoid 41 and allow sufficient time for solenoid 41 to reset, which time delay is provided by the $\overline{Q}$ output **63*c* of one-shot multivibrator 63 feeding the CSBSY'. In addition, the line feed signal is inhibited, bistable flip-flop 56 is cleared and bistable flip-flop 62 is also cleared at the end of the timing cycle of one shot multivibrator 63. Thus, the circuit 50** is back to its starting state, data is read in (i.e. the black line portion interspersed with spaces for the characters previously printed in red) and printing ensues. Since line feed was inhibited, printing occurs over the same line that the previously printed red characters were printed upon, and, due to the composition of each line portion, as was previously described, red and black characters are now intermixed on a single line.

Thus it can be seen that the red/black logical circuitry 50 of FIG. **3*a* accepts the normal $\overline{\text{PMSOL}}$, $\overline{\text{FWDCLD}}$, $\overline{\text{REVCLD}}$, and $\overline{\text{CSBSY}}$ signals and produces modified signals which are either time-delayed or inhibited to allow the desired red/black printing operation. The resulting signals produced are labeled $\overline{\text{PMSOL}}'$, $\overline{\text{REVCLD}}'$, $\overline{\text{FWDCLD}}'$, and $\overline{\text{CSBSY}}'$. In addition, the circuit provides a signal required to position the inked printing ribbon 31 in its proper position in front of the print head assembly 23**.

The 90 millisecond delay caused by one-shot multivibrators 57 and 63 is utilized to allow the inked ribbon solenoid 41 to completely activate and deactivate prior to the initiation of printing so as to be assured that the ribbon portion **31*a* or 31*b* of the proper color is positioned before printing begins. The latter time value is used only as an example and the actual setting is dependent upon the speed of the ribbon solenoid 41 and the engagement time of the forward and reverse clutches 17 and 29. Thus, the actual pulse width produced by multivibrators 57 and 63 depends only upon the response time of the particular clutches 17, 29 and solenoid 41 employed in the printer 10**.

UNI-DIRECTIONAL PRINTING

Figure 4B:
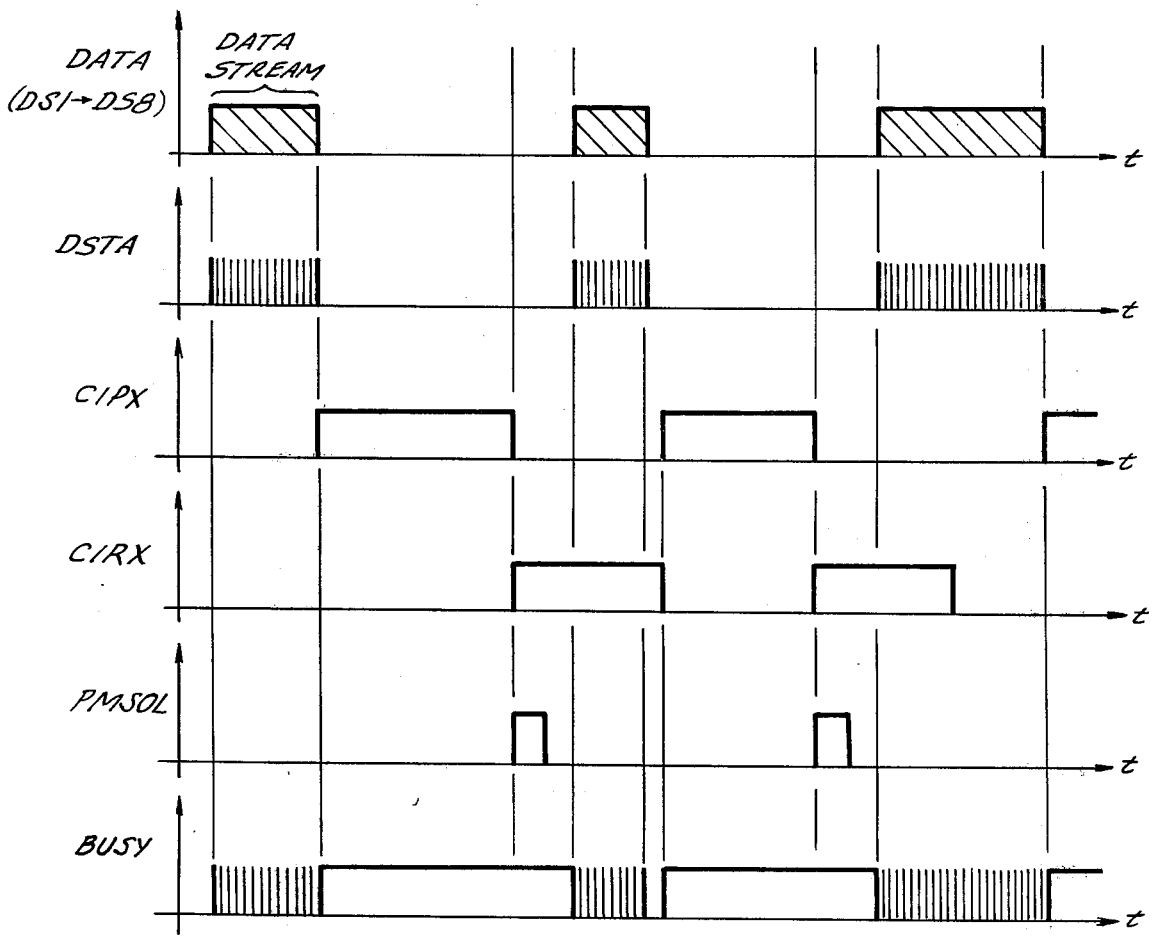
FIG. 4*b* is a coordinated set of graphs of logic signals used with the logic circuitry of FIG. 4*a.*

In a uni-directional printer 10, printing is done in one direction only. When printing of a line is complete, the print head assembly 23 is rapidly returned to the left-hand margin in preparation for printing the next line of data. Thus, forward motion of the print head assembly 23 is always followed by a rapid return to its starting point either under control of the return spring (not shown) or reverse clutch 29 as was previously described. During the carriage return time, the line feed is performed and data entry for the next line is started. The logical circuitry 80 for the red/black print logic for unidirectional printer 10 is shown in FIG. **4*a* while FIG. 4*b* shows the significant signal levels for unidirectional printer 10** with the red/black print capability disconnected.

The signals of interest are:

(a) PMSOL-paper movement solenoid signal which signals are utilized to activate the line feed signal and is the same as that described in connection with the bi-directional printer 10.

(b) DS1–DS8 — these are the data inputs (similar to those described in connection with the bi-directional printer 10 with the codes defined by the combination of binary 1's and 0's on these lines corresponding to printable characters or control codes recognized by the printer electronics).

(c) DSTA — the data strobe signal which strobes in the DS1–DS8 data levels into the printer shift register 11 (FIG. 1).

(d) CIPX — this signal is employed to activate the forward clutch 17 and is high when printing is in progress.

(e) CIRX — this signal activates the printer reverse clutch 29 after printing of a line is complete and results in the print head assembly 23 rapidly returning to the lefthand margin. As an alternative, in a printer 10 in which return of the print head assembly 23 and carriage member 33 to the lefthand margin is under the control of a return spring, signal CIRX goes high during the return stroke, which encompasses the interval between CIPX going low and subsequent activation of the left-hand margin limit switch.

(f) CSBSY — this cause-busy signal forces the printer electronics 80 into a BUSY condition which is employed by the printer 10 to tell the data source (computer or the like) to stop sending data.

In FIG. **4*b* it can be seen that no data is accepted by the printer 10 during the printing interval or during a portion of the head 23** return interval (i.e. during occurrence of the PMSOL signal and for a fixed time thereafter). Data input starts, in general, during the latter portion of the head return stroke and, depending upon the data source rate, may or may not be completed at the time that the print head assembly 23 returns to the left-hand margin of the paper document 12. If data entry of the next line is not complete at the end of the head return stroke, the print head assembly 23 waits at the lefthand margin until data entry is completed and, at that time, printing ensues.

The red/black logic circuitry 80 of FIG. 4*a* utilizes the previously described signals whose wave forms are shown in FIG. 4*b* and modifies, delays or deletes such signals in such a way as to accomplish the functional red/black printing performance previously described. Logical circuitry 80 of FIG. 4*a* also produces the signal required to position the red and black portions 31*a*, 31*b* of the ink printing ribbon 31 in front of the print head assembly 23 by way of the solenoid 41 of FIG. 1.

Considering FIG. 4*a*, wherein like circuit components as between FIGS. 3*a* and 4*a* are designated by like numerals, let it be assumed that the red/black control code (octal 024) is received on the data lines. At the time the data strobe DSTA is applied to NAND gate 55 and accompanying the octal 024 control code, the output of NAND gate 51 goes low. This state is inverted by inverter 54 and applied to one input of NAND gate 55. The data strobe signal DSTA applied to NAND gate 55 allows the output of NAND gate 55 to go low, setting bistable flip-flop 56 so that its Q and $\overline{Q}$ outputs 56*b* and 56*c* respectively go high and low. The $\overline{Q}$ output is applied through NAND gate 60 causing the R/B SOL. DRIVER signal at the output of NAND gate 60 to go high. This signal activates solenoid 41 (see FIG. 2) which positions the red portion 31*b* of ribbon 31 in front of the print head assembly 23. The output of NAND gate 55, when low, also triggers one-shot multivibrator 57. The 90 millisecond pulse developed at the $\overline{Q}$ output 57*b* serves to inhibit the CIPX signal applied to one input of gate 58 and inverted by inverter 81, to prevent the forward clutch 17 from activating until the R/B solenoid 41 has been fully engaged. Thus, the signal CIPX' replaces the signal CIPX in driving the forward clutch 17. The first line portion of data is then shifted into the printer register 11. Printing of red characters begins when the signal CIPX' goes high. When the red characters have been printed, CIPX goes low, as does CIPX', and the signal CIRX goes high. Generation of the signal CIRX corresponds to the start of the reverse return motion of the print head assembly 23 including the carriage member 33. In addition thereto, CIRX is applied to the clock input 62*d* of bistable flip-flop 62. Since the D input 62*a* is high due to the setting of bistable flip-flop 56 by the octal 024 control code, the effect of CIRX is to set bistable flip-flop 62 so that its Q output 62*b* goes high. This triggers one shot multivibrator 63 which causes the following:

(a) the $\overline{Q}$ output 63*c* remains low for 90 milliseconds. Its output is coupled to one input of NAND gate 69 inhibiting the PMSOL signal from being passed by NAND gate 69 and hence inhibits the PMSOL' signal appearing at the output of inverter 82. The PMSOL' output is employed for line feed and hence the line feed is inhibited.

(b) the low going level at output 63*c* also clears bistable flip-flop 56 by way of NAND gate 64, inverter 65 and jumper 66. The $\overline{Q}$ output 56*c* goes high causing the output of NAND gate 60 (R/B SOL. DRIVER signal) to go low, resetting the solenoid 41 to its black print condition.

(c) a low level output 63*c* of one shot multivibrator 63 is also coupled to one input of NAND gate 67 forcing the signal CSBSY' high and, since CSBSY' is the output of one shot multivibrator 63 OR'ed with the printer CSBSY signal applied through inverter 84, the printer 10 is forced into a busy condition and no data is read in until a low going pulse applied to gate 67 from one shot multivibrator 63 is terminated.

In summary, the signal CIRX causes the red/black solenoid 41 to reset, clears bistable flip-flop 56, inhibits the line feed signal and, via CSBSY', provides sufficient time for the red/black solenoid 41 to reset before further data can be read in (and therefore delays the occurrence of printing).

When one shot multivibrator 63 times out, its Q output 63*b* shifts to the low state causing one shot multivibrator 71 to produce a pulse at its $\overline{Q}$ output 71*b* clearing bistable flip-flop 62 and driving its Q output 62*b* low. When one shot multivibrator 63 clears, the signal CSBSY' is no longer forced high, and, provided CSBSY is not high, CSBSY' goes low allowing data to be read in. At this time the second line portion consisting of coded characters representing the black characters to be printed and interspersed with blank or spaced codes is loaded into register 11 (FIG. 1). Since the line feed signal was inhibited, the latter data portion will be printed along the same line that the previous red characters were printed in an appropriate intermixed fashion. At this time it should also be noted that the circuit 80 has returned to its initial state.

FIGS. 3*a* and 4*a* show jumper connections 66, 66*a* and 66*b* which may be utilized to disable circuits 50 and 80. Jumper 66 is in the circuit path coupled to the CLEAR input of flip-flop 56; jumper 66*a* is in the circuit path coupled to the PRESET input of flip-flop 56 an to the TRIGGER input of one shot multivibrator 57; and jumper 66*b* is in the circuit path coupled between the $\overline{Q}$ output 63*c* of multivibrator 63 and one input of gate 69. When the circuits 50 and 80 are enabled, the jumpers 66, 66*a* and 66*b* are wired in the solid line fashion. To disable the circuit 80, the jumpers are wired in the dotted fashion 66', 66*a*' and 66*b*', respectively. Thus, the PRESET input of bistable flip-flop 56 is disconnected from the circuitry 50 or 80 and is connected to a plus 5 volts level. It should further be noted that input 57*a* would also be coupled to the same 5 volt level. The CLEAR input of flip-flop 56 is connected directly to ground clearing flip-flop 56 so that the Q and $\overline{Q}$ outputs are binary zero and binary 1 respectively. The lead going to the PMSOL gate 69 is coupled to plus 5 volts. The effect of these disabled jumpers 66, 66*a* and 66*b* is as follows:

(a) PMSOL — This signal comes out directly as PMSOL' in FIG. 4*a*. In FIG. 3*a* the signal $\overline{\text{PMSOL}}$ comes out directly as $\overline{\text{PMSOL'}}$ and is not effected by any inhibiting function (i.e., PMSOL = PMSOL' and $\overline{\text{PMSOL}} = \overline{\text{PMSOL'}}$).

(b) With bistable flip-flop 56 cleared and disconnected from the rest of the circuit 80, there is a permanent high on the input of NAND gate 60 coupled to the $\overline{Q}$ output 56*c* of bistable flip-flop 56. Provided the switch 86 coupled to the other input of NAND gate 60 is connected to the R/B contact, the R/B solenoid 41 is disabled.

(c) With bistable flip-flop 56 and one shot multivibrator 57 disabled, $\overline{\text{FWDCLD}}$ equals $\overline{\text{FWDCLD'}}$ and $\overline{\text{REVCLD}}$ equals $\overline{\text{REVCLD'}}$ (see FIG. 3*a*) and these signals are unaffected by any inhibiting or delaying signals. Also, since one shot multivibrator 63 is inactive, $\overline{\text{CSBSY}}$ equals CSBSY'. In FIG. 4*a*, CIPX equals CIPX', PMSOL equals PMSOL', and CSBSY equals CSBSY'. Thus the printer 10 appears as though no red/black logical circuitry 80 is provided since the signal inputs pass through unaffected and since an octal 024 control code has no effect.

The red/black switch 86, when connected to the red only contact, forces the $\overline{\text{R/B LOGIC}}$ signal of FIG. 3*a* low, causing the solenoid 41 to be permanently activated so that the red portion 31*b* of ribbon 31 will remain in front of the print head assembly 23 at all times. In FIG. 4*a* the R/B SOL DRIVER is forced high with the same result. Also, the one shot multivibrators 57 and 63 remain in the cleared state, preventing them from affecting signals which their outputs normally inhibit or delay.

It can thus be seen from the foregoing, that the present invention provides a unique arrangement for printing intermixed characters of two different colors when employing or employed in either uni-directional or bi-directional type printers. In uni-directional printers, the printer control means (i.e. computer, for example) transmits character codes for those character positions to be printed in red with the remaining interspersed positions being occupied by space codes. The red characters are then printed as the print head assembly moves from left to right. Upon completion of the line, the print head assembly is abruptly moved to the left margin and the normally generated line feed signal is inhibited to prevent the occurrence of a line feed operation. Thereafter the computer transmits the code combinations for the black characters interspersed with blank or space codes at the positions occupied by the previously printed red characters. As soon as the register is fully loaded, printing begins on the same line so that, upon completion of printing the black characters, a resulting line of intermixed red and black characters is produced.

The same basic operation is performed in bi-directional printers except that the printing of black characters (interspersed with blank spaces for the previously printed red characters) occurs when the print head assembly is moving in the direction opposite the direction used for printing red characters with the same line feed operation having been inhibited. In addition thereto printing is delayed by the one shot multivibrators for a time sufficient to allow shifting of the print ribbon. The above techniques permit printing of all red, all black or intermixed red and black characters at a minimum reduction in printing speed.

Although there has been described a preferred embodiment of this invention, many variations and modifications will now be apparent to those skilled in the art. Therefore, this invention is to be limited, not by the specific disclosure herein, but only by the appended claims.

What is claimed is:

1. Apparatus for providing two-color printing in an impact printer having platen means for supporting a paper document, a print head assembly and carriage means including means for moving the carriage means and print head assembly across the paper document, said print head assembly including a plurality of print wires and means for selectively activating the print wires to impact said paper document, and means responsive to carriage movement for enabling said activating means, said apparatus comprising:

an elongated inked ribbon extending across the paper document and having first and second colored portions;

means movable between first and second positions for selectively positioning each of said first and second colored portions respectively adjacent said print wires responsive to the receipt of respective first and second signals;

decoder means responsive to a color selection code for generating a ribbon setting signal prior to the printing of each line of characters and/or symbols to select the color in which that line is printed and means for retaining the ribbon setting signal until the line is printed; and means responsive to completion of the printing of a first group of characters on a line in a first color for operating said carriage moving means to cause the carriage moving means to move the carriage means to a position in readiness for printing additional characters in a second color and to then move the carriage means to begin printing in said second color on the same line;

means responsive to said decoder means for delaying the operation of said carriage moving means for beginning a printing operation, until the selected one of said first and second colored portions is stably positioned between said print wires and said paper document whereby said delaying means assures printing of additional characters on the same line will occur in the proper color.

2. Apparatus as set forth in claim 1, further including settable color selection means having first and second positions for respectively retaining said positioning means in said first and second positions to print characters in successive lines in only the selected color even if said signal generating means generates a signal for the remaining color.

3. Apparatus as set forth in clain 1, further including signal generating means for generating a ribbon resetting signal responsive to the completion of printing of a line in the color selected by operation of said decoder means to energize said positioning means to enable printing in the remaining color.

4. Apparatus as set forth in claim 3, further including means for resetting said signal generating means to generate said ribbon resetting signal in the absence of the receipt of a color selecting code prior to the printing of each line.

5. Apparatus for providing two-color printing in an impact printer having platen means for supporting a paper document, a print head assembly and carriage means for moving the print head assembly across the paper document, said print head assembly including a plurality of print wires and means for selectively activating the print wires to impact said paper document, and means responsive to carriage movement for enabling said activating means, said apparatus comprising:

an elongated inked ribbon extending across the paper document and having first and second colored portions;

means movable between first and second positions for selectively positioning each of said first and second colored portions respectively adjacent said print wires responsive to the receipt of respective first and second signals;

decoder means responsive to a color selection code for generating a ribbon setting signal prior to the printing of each line of characters and/or symbols to select the color in which that line is printed and means for retaining the ribbon setting signal until the line is printed; and means responsive to said decoder means for delaying the operation of said carriage moving means until the selected one of said first and second color portions is stably positioned between said print wires and said paper document whereby said delaying means assures printing will occur in the proper color;

signal generating means for generating a ribbon resetting signal responsive to the completion of printing of a line in the color selected by operation of said decoder means to energize said positioning means to enable printing in the remaining color;

means for resetting said signal generating means to generate said ribbon resetting signal in the absence of the receipt of a color selecting code prior to the printing of each line;

said signal generating means comprising a first bistable element having a first input, a second input and an output, said output generating said ribbon setting signal responsive to an enabling signal at said first input and said output generating said ribbon resetting signal responsive to an enabling signal at said second input;

said decoder means having an output coupled to said first input to apply the ribbon setting signal thereto responsive to the receipt of said color selection code;

said resetting means being coupled to said second input to apply said ribbon resetting signal responsive to the completion of a line of print and to the absence of said color selection code.

6. Apparatus as set forth in claim 5, wherein the decoder means for generating the ribbon setting signal comprises first means for generating said ribbon resetting signal a first time interval after completion of printing a line of characters; and a second bistable element having a data input coupled to the output of said first bistable element, a clock input energized upon completion of printing of a line of characters, and an output enabling said first means only if an enabling signal is present at said first bistable element output when said clock input is energized.

7. Apparatus for providing two-color printing in an impact printer having platen means for supporting a paper document, a print head assembly and carriage means including means for moving the carriage means and print head assembly across the paper document, said print head assembly including a plurality of print wires and means for selectively activating the print wires to impact said paper document, and means responsive to carriage movement for enabling said activating means, said apparatus comprising:

an elongated inked ribbon extending across the paper document and having first and second colored portions;

means movable between first and second positions for selectively positioning each of said first and second colored portions respectively adjacent said print wires responsive to the receipt of respective first and second signals;

decoder means responsive to a color selection code for generating a ribbon setting signal prior to the printing of each line of characters and/or symbols to select the color in which that line is printed and means for retaining the ribbon setting signal until the line is printed; and means responsive to said decoder means for delaying the operation of said carriage moving means until the selected one of said first and second colored portions is stably positioned between said print wires and said paper document whereby said delaying means assures printing of characters on the line will occur in the proper color;

signal generating means for generating a ribbon resetting signal responsive to the completion of printing of a line in the color selected by operation of said decoder means to energize said positioning means to enable printing in the remaining color on the same line;

paper advancing means for advancing the paper document in line feed fashion responsive to a line feed signal;

means for generating a line feed signal responsive to completion of a line of print;

means for inhibiting the application of a line feed signal to said paper advancing means to prevent advancing of said paper document until said paper document is printed at selected character positions in said selected color and at selected ones of at least some of the remaining character positions in said remaining color.

8. Apparatus as set forth in claim 7, wherein said printer includes means to enable printing during motion of said carriage means in either direction, said printer further comprising means for providing said color selection code at said decoder means prior to the commencement of motion of said carriage means in a first direction across a paper document to enable printing of characters in a first color at selected positions along said line of characters; and means for enabling said line feed signal inhibiting means and said decoder means prior to the commencement of motion of said carriage means in a second direction opposite said first direction to energize said positioning means to move the ribbon to the remaining color position whereby characters in said remaining color are printed at at least some of the remaining positions and intermixed with said first color characters along said line of characters while said carriage means moves in the second direction.

9. Apparatus as set forth in claim 7, wherein said printer prints during motion of said carriage means only in a first direction, said printer further comprising means for providing said color selection code at said decoder means prior to the commencement of motion of said carriage means in said first direction across the paper document to enable printing of characters in a first color at selected positions along said line of characters; and means for enabling said line feed signal inhibiting means and said decoder means while said carriage means moves in a second direction opposite said first direction to return to a position preparatory to resuming motion in said first direction, thereby causing characters in said remaining color to be printed at at least some of the remaining positions and intermixed with said first color characters along said line of characters while said carriage means moves across the document a second time in said first direction.

10. Apparatus for providing two-color printing in an impact printer having platen means for supporting a paper document, a print head assembly and carriage means including means for moving the carriage means and print head assembly across the paper document, said print head assembly including a plurality of print wires and means for selectively activating the print wires to impact said paper document, and means responsive to carriage movement for enabling said activating means, said apparatus comprising:

an elongated inked ribbon extending across the paper document and having first and second colored portions;

means movable between first and second positions for selectively positioning each of said first and second colored portions respectively adjacent said print wires responsive to the receipt of respective first and second signals;

decoder means responsive to a color selection code for generating a ribbon setting signal prior to the printing of each line of characters and/or symbols to select the color in which that line is printed and means for retaining the ribbon setting signal until the line is printed, and means responsive to said decoder means for delaying the operation of said carriage moving means until the selected one of said first and second colored portions is stably positioned between said print wires and said paper document whereby said delaying means assures printing will occur in the proper color;

said delaying means comprising means for generating a first output level for a predetermined time interval responsive to the commencement of each of said ribbon setting signals at said decoder means; and gating means receiving said first output level for inhibiting the energization of said carriage means during said predeterined time interval.

11. A printer having platen means for supporting a paper document, a print head assembly and carriage means for moving the print head assembly across the paper document, an elongated ribbon having plural colored portions extending along the length of the ribbon, said print head assembly including a plurality of print wires and activating means for driving said print wires to impact said ribbon and paper document, means responsive to movement of said carriage means for enabling said activating means, and means for providing shifting signals to enable shifting of the ribbon to place one of said color portions adjacent said print wires, and apparatus comprising:

said ribbon extending across the paper document;

a reciprocating guide member having a first end for slidably receiving and supporting a portion of said ribbon, said guide member being slidably mounted on said carriage means for shifting said ribbon in a direction transverse to the path of movement of the carriage means; and ribbon drive means displaced from said carriage means for selectively moving said guide member in either a first or a second direction responsive to the shifting signal received to position a respective portion of the ribbon adjacent said print wires;

said ribbon drive means comprising a linking member having a non-circular opening formed therethrough and having a projecting extending therefrom; an actuator shaft rotatable about its longitudinal axis and positioned a spaced distance from said carriage means, said actuator shaft having a cross-section conforming to and received by said non-circular opening, said linking member being freely slidable along said actuator shaft; and solenoid means for rotating said actuator shaft and hence said projection of said linking member to one of a plurality of angular positions responsive to the receipt of each different one of said shifting signals; said projection cooperating with said guide member to move said guide member and hence position different colored portions of said ribbon adjacent to said print wires.

12. A printer as set forth in claim 11, wherein said slidably mounted linking member moves along said shaft under control of said guide member.

13. A method for printing a line of intermixed first and second colored characters for use with a printer comprising platen means for supporting a paper document, print means including print wires for impacting the paper document to form dot patterns, carriage means for moving the print means across the paper document, means for selectively actuating the print means responsive to carriage movement, and means for selectively positioning each of a first and second colored ribbon portion adjacent to the print means, said method comprising the steps of:

receiving and storing a first subline of intermixed data and space codes and a function code, each of the data codes representative of a character or a symbol to be printed in a first color at selected positions along the line, each of the space codes representative of a blank space at remaining positions along the line;

positioning one of the first and second colored ribbon portions adjacent the print means responsive to the receipt of a color selection code;

activating the carriage means to move the print means from a start position across the paper document in a first direction;

stepping the data out of storage and printing during the movement of the carriage means in the first direction the first subline of characters and symbols responsive to the first subline of data received and in the color selected by the function code;

inhibiting a line feed operation which occurs when either a line or a subline of print is completed to prevent movement of the paper document at the end of movement of the carriage means in the first direction after printing of the first subline of data;

positioning a remaining one of the first and second colored ribbon portions adjacent the print wires responsive to the completion of printing the first subline of characters and symbols;

receiving and storing a second subline of intermixed data and space codes, each of the data codes representative of a character or symbol to be printed in a second color at one or more of the blank spaces positioned along the line of characters and symbols presently being printed, a space code occurring for each position of a character or symbol printed in the first color along the line of characters;

activating the carriage means to move in a second direction opposite the first direction across the paper document after the second subline of data and space codes is stored;

stepping the contents out of storage and printing in the second color during the motion of the carriage means in the second direction the second subline of characters and symbols interspersed with the previously printed first subline responsive to the second subline of data received; and delaying the line feed operation which moves the platen means and the paper document to a position for printing the next line of characters and symbols for a period sufficient to enable the carriage means to completely move across the paper document in the second direction and reposition the ribbon portions.

14. A method for printing a line of intermixed first and second colored characters for use with a printer comprising platen means for supporting a paper document, print means including print wires for impacting the paper document, carriage means for moving the print means across the paper document, means for selectively actuating the print means responsive to carriage movement, and means for selectively positioning each of a first and second colored ribbon portion adjacent to the print means, said method comprising the steps of:

receiving and storing a first subline of intermixed data and space codes and a color selection code, each of the data codes representative of a character or a symbol to be printed in a first color at selected positions along the line, each of the space codes representative of a blank space at remaining positions along the line;

positioning one of the first and second colored ribbon portions adjacent the print means responsive to the color selection code received;

activating the carriage means to move the print means across the paper document in a first direction;

advancing the codes out of storage at the printing rate controlled by the carriage means, and printing during the movement of the carriage means in the first direction the first subline of characters and symbols responsive to the first subline of data received;

inhibiting a line feed operation otherwise performed upon completion of either a line or a subline of characters to prevent movement of the platen means at the end of movement of the carriage means in the first direction;

returning the carriage means in a second direction opposite the first direction to the initial position preparatory to renewed motion in the first direction while preventing paper advancement;

positioning a remaining one of the first and second colored ribbon portions adjacent the print wires responsive to the completion of printing the first subline of characters and symbols;

receiving and storing a second subline of intermixed data and space codes, each of the data codes representative of a character or symbol to be printed in a second color at selected ones of the blank spaces positioned along the line of characters and symbols presently being printed, a space code occurring for each position of a character or symbol printed in the first color along the line of characters presently being printed;

activating the carriage means to move a second time in the first direction across the paper document;

stepping the codes out of storage at said printing rate and printing in the second color during the second motion of the carriage means in the first direction the second subline of characters and symbols responsive to the second subline of data received; and delaying both the return of the carriage means to the start position and the advancement of the paper document to a position for printing the next successive line of characters and symbols for a period sufficient to enable the carriage means to complete moving across the paper document in the first direction.

* * * * *

UNITED STATES PATENT AND TRADEMARK OFFICE

CERTIFICATE OF CORRECTION

PATENT NO. : 4,073,371

DATED : February 14, 1978

INVENTOR(S) : Jay Prager, Hudson, N.H.

It is certified that error appears in the above-identified patent and that said Letters Patent are hereby corrected as shown below:

Column 9, line 52, the numeral "50" should read -- 80 --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*